US008344987B2

(12) United States Patent
Jeoung et al.

(10) Patent No.: US 8,344,987 B2
(45) Date of Patent: Jan. 1, 2013

(54) LIQUID CRYSTAL DISPLAY DEVICE WITH LENGTH OF SIGNAL PATH MINIMIZED

(75) Inventors: Hun Jeoung, Gyeongbuk (KR); Ji Won Jung, Daegu (KR)

(73) Assignee: LG Display Co., Ltd., Seoul (KR)

( * ) Notice: Subject to any disclaimer, the term of this patent is extended or adjusted under 35 U.S.C. 154(b) by 318 days.

(21) Appl. No.: 12/585,653

(22) Filed: Sep. 21, 2009

(65) Prior Publication Data

US 2010/0156776 A1 Jun. 24, 2010

(30) Foreign Application Priority Data

Dec. 23, 2008 (KR) ..... 10-2008-0132113

(51) Int. Cl.
*G09G 3/36* (2006.01)

(52) U.S. Cl. ..... 345/98; 345/100

(58) Field of Classification Search ..... 345/87–104
See application file for complete search history.

(56) References Cited

U.S. PATENT DOCUMENTS

| | | | | |
|---|---|---|---|---|
| 5,448,260 | A * | 9/1995 | Zenda et al. | 345/100 |
| 7,714,826 | B2 * | 5/2010 | Jang et al. | 345/98 |
| 2006/0187175 | A1 * | 8/2006 | Lo et al. | 345/100 |
| 2008/0036717 | A1 * | 2/2008 | Moon | 345/87 |
| 2009/0289878 | A1 * | 11/2009 | Chen | 345/87 |

FOREIGN PATENT DOCUMENTS

| | | |
|---|---|---|
| CN | 1648981 | 8/2005 |
| CN | 1809862 | 7/2006 |

* cited by examiner

*Primary Examiner* — Chanh Nguyen
*Assistant Examiner* — James Nokham
(74) *Attorney, Agent, or Firm* — McKenna Long & Aldridge LLP

(57) ABSTRACT

The LCD device allows the three demultiplex signal lines to connect the center portion of the data driver with the center portion of the demultiplexer.

10 Claims, 5 Drawing Sheets

LIQUID CRYSTAL DISPLAY DEVICE WITH LENGTH OF SIGNAL PATH MINIMIZED

This application claims priority under 35 U.S.C. 119 to Korean Patent Application No. 10-2008-0132113, filed on Dec. 23, 2008, which is hereby incorporated by reference for all purposes as if fully set forth herein.

BACKGROUND

1. Field of the Disclosure

This disclosure relates to a liquid crystal display device adapted to reduce the number of output channels.

2. Description of the Related Art

As the information society grows, display devices capable of displaying information have been widely developed. These display devices include liquid crystal display (LCD) devices, organic electro-luminescence display (OLED) devices, plasma display devices, and field emission display devices.

Among the above display devices, LCD devices have the advantages that they are light and small and can provide a low power drive and a full color scheme. Accordingly, LCD devices have been widely used for mobile phones, navigation systems, portable computers, televisions and so on. Such LCD devices control the transmittance of a liquid crystal on a liquid crystal panel, thereby displaying a desired image.

FIG. 1 is a schematic diagram showing an LCD device of the related art. As shown in FIG. 1, an LCD device of the related art includes a liquid crystal panel 100, and a gate driver 110 and a data driver 120 for driving the liquid crystal panel 100.

The liquid crystal panel 100 includes a plurality of gate lines and a plurality of data lines which are arranged on it. The gate driver 110 generates gate signals for sequentially driving the plural gate lines on the liquid crystal panel 100. The data driver 120 applies the data voltages for one line to the plural data lines whenever any one of the gate lines is driven.

The data voltages for one line are applied to all the data lines on the liquid crystal panel 100 through the output channels of the data driver 120. The output channels of the data driver 120 are opposite each of the data lines on the liquid crystal panel 100.

In an LCD device of such a configuration, the data lines increase in number as the liquid crystal panel 100 becomes larger. As such, the output channels of the data driver 120 also increase in number. Consequently, enlarging the size of the data driver 120 can be a problem.

BRIEF SUMMARY

Accordingly, the present embodiments are directed to an LCD device that substantially obviates one or more of problems due to the limitations and disadvantages of the related art.

An advantage of the present embodiment is to provide an LCD device capable of reducing the number of output channels of an integrated circuit (IC).

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to one general aspect of the present embodiment, an LCD device includes: a liquid crystal panel defined into a display area, on which a plurality of gate lines and a plurality of data lines are arranged, and a non-display area; a control portion configured to include a data driver; a plurality of first and second lines connected to the output stage of the control portion; and a demultiplexer configured to connect k data lines of the data lines with one line of the first signal lines and to sequentially apply data voltages, wherein the second signal lines are connected between the center portion of the control portion and the center portion of the demultiplexer and "k" is an integer of at least 3.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
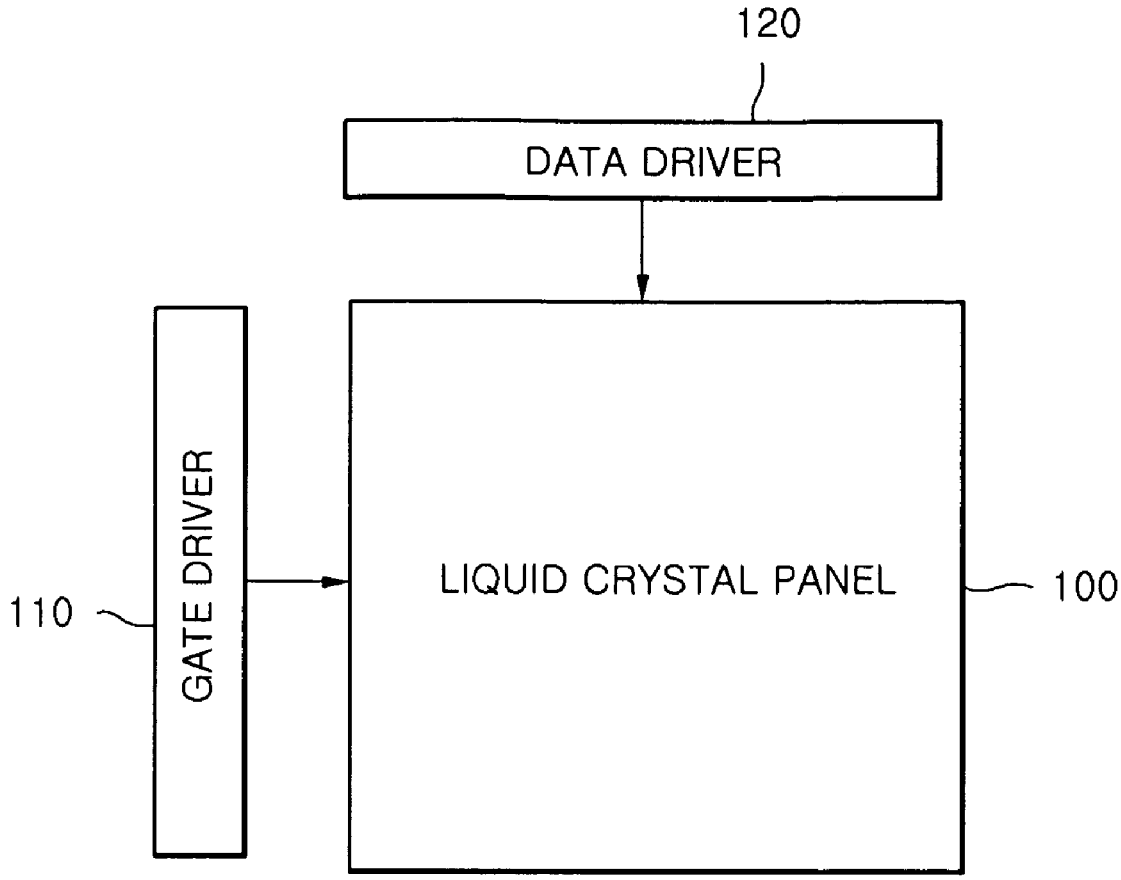
FIG. 1 (Related Art)
FIG. 1 is a schematic diagram showing an LCD device of the related art.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

Figure 2:
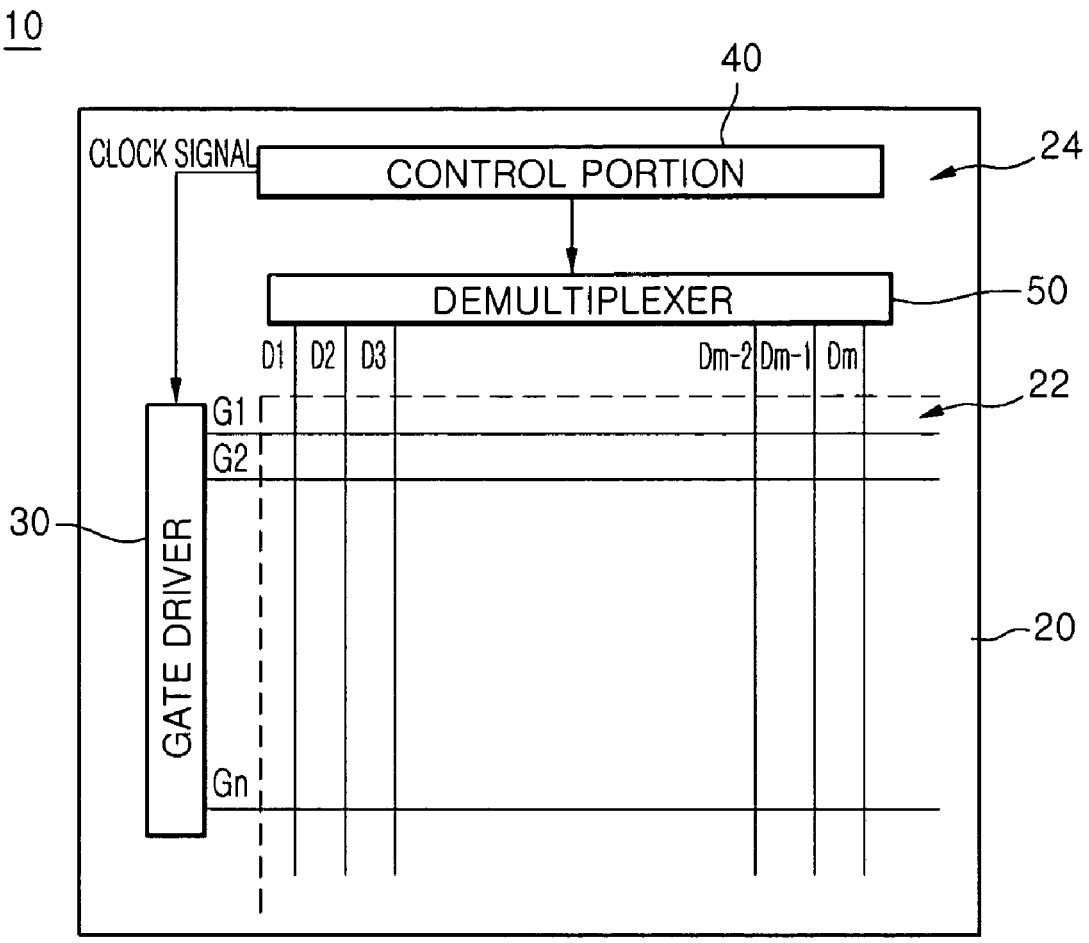
FIG. 2 is a schematic diagram showing an LCD device according to a first embodiment of the present disclosure.

FIG. 2 is a schematic diagram showing an LCD device according to a first embodiment of the present disclosure. Referring to FIG. 2, an LCD device 10 according to a first embodiment of the present disclosure includes a liquid crystal panel 20 on which a gate driver 30, a control portion 40, and a demultiplexer 50 are mounted. The control portion 40 is mounted on the liquid crystal panel 20 in a chip-on-glass (COG) type. The gate driver 30 and the demultiplexer 50 may be formed simultaneously with components of the liquid crystal panel 20.

The demultiplexer 50 may be a demultiplexer of 1:k, where "k" is an integer of at least 3.

The liquid crystal panel 20 is divided into a display area 22 displaying an image and a non-display area 24 not displaying any images. The gate driver 30, the control portion 40, and the demultiplexer 50 can be arranged on the non-display area 24. The liquid crystal panel 20 includes first and second substrates and a liquid crystal layer (not shown) interposed between the substrates.

A plurality of gate lines G1~Gn and a plurality of data lines D1~Dm are arranged on the first substrate. The plural gate lines G1~Gn and data lines D1~Dm may cross each other to define a plurality of pixel regions. The plural pixel regions may be arranged in a matrix shape on the display area 22.

A thin film transistor (not shown) and a pixel electrode (not shown) are disposed on each of the pixel regions. The thin film transistor may be connected to the respective gate line G and the respective data line D. The pixel electrode may be connected to the thin film transistor.

A color filter layer (not shown) including color filters (not shown) each opposite to the pixel regions may be disposed on the second substrate. Also, a black matrix (not shown) may be disposed between the color filters. Furthermore, a common electrode (not shown) may be disposed on the color filter layer and the black matrix.

The liquid crystal panel 20 with such a configuration may be of a twisted nematic (TN) mode. Alternatively, the liquid crystal panel 20 can be formed in an in-plane switching (IPS) mode. In this case, the color filter layer, the black matrix, and the common electrode can be disposed on the first substrate.

Figure 3:
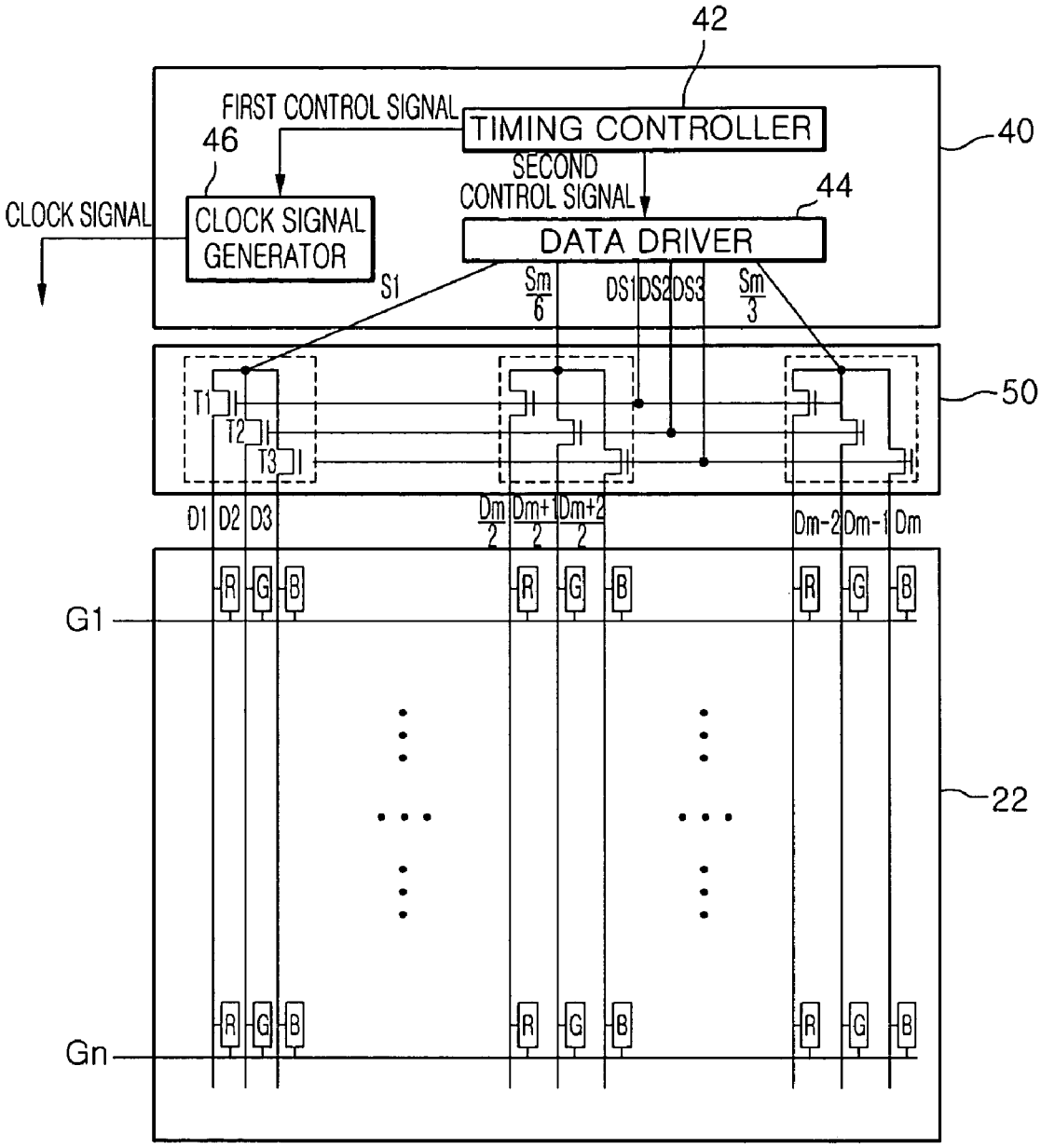
FIG. 3 is a circuitry diagram showing in detail the control portion and the demultiplexer shown in FIG. 2.

The control portion 40 may be packaged into an integrated circuit chip and may be mounted on the liquid crystal panel 20 in a chip. The control portion 40 includes a timing controller 42, a data driver 44, and a clock signal generator 46, as shown in FIG. 3.

The timing controller 42 generates a first control signal to be applied to the clock signal generator 46, and a second control signal for controlling the data driver 44.

The clock signal generator 46 derives clock signals for driving the gate driver 30 from the first control signal. The clock signals can be generated to have between two to four phases. Alternatively, the clock signals can become gate signals which are applied from the gate driver 30 to the gate lines G1~Gn on the liquid crystal panel 20.

The data driver 44 derives demultiplex signals, which are applied to the demultiplexer 50, from the second control signal. Also, the data driver 44 may include output pins provided in its output stage. The output pins can be assigned to data channels for outputting data voltages and demultiplex channels for outputting the demultiplex signals. As such, the output pins for the data channels may be connected to the data signal lines S1~Sm/3 provided on the liquid crystal panel 20, and the output pins for the demultiplex channels may also be connected to the demultiplex signal lines DS1~DS3.

The demultiplexer 50 may include input terminals connected to the data signal lines S1~Sm/3 and the demultiplex signal lines DS1~DS3, and output terminals connected to the data lines D1~Dm of the liquid crystal panel 20. Also, the demultiplexer 50 includes a plurality of switch units 52.

Each of the switch units 52 may include three transistors T1~T3. The gate terminals of the three transistors T1~T3 are connected to the respective demultiplex signal lines DS1~DS3. The source terminals of the three transistors T1~T3 may be commonly connected to one data signal line. The drain terminals of the three transistors T1~T3 may be connected to three data lines of the liquid crystal panel 20. However, the switch units 52 of the present embodiment are not limited to this. In other words, the switch units 52 can include k switchers (or k transistors) which can be connected to the respective k data lines, where "k" is an integer of at least 3.

For example, the gate terminals of the three transistors T1~T3 included in the first switch unit 52 are connected to the respective demultiplex signal lines DS1~DS3. The source terminals of the three transistors T1~T3 may be commonly connected to one data signal line S1. The drain terminals of the three transistors T1~T3 may be connected to three data lines D1~D3 of the liquid crystal panel 20.

More specifically, the gate terminal of the first transistor T1 can be connected to the first demultiplex signal line DS1, and the drain terminal of the first transistor T1 can be connected to the first data line D1. The gate terminal of the second transistor T2 can be connected to the second demultiplex signal line DS2, and the drain terminal of the second transistor T2 can be connected to the second data line D2. The gate terminal of the third transistor T3 can be connected to the third demultiplex signal line DS3, and the drain terminal of the third transistor T3 can be connected to the third data line D3.

The first gate line G1 and the first data line D1 can cross each other and can define a red pixel region R. The first gate line G1 and the second data line D2 can cross each other and can define a green pixel region G. The first gate line G1 and the third data line D3 can cross each other and can define a blue pixel region B. As such, a red data voltage can be applied to the red pixel region R through the first data line D1, a green data voltage can be applied to the green pixel region G through the second data line D2, and a blue data voltage can be applied to the blue pixel region B through the third data line D3.

Figure 4:
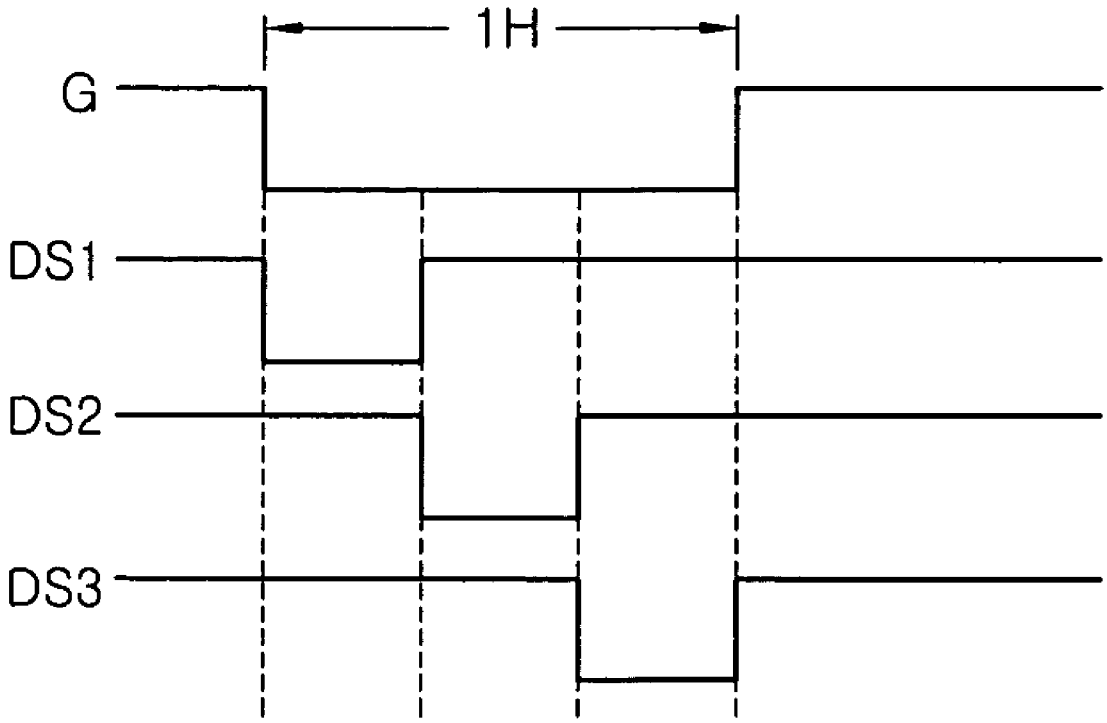
FIG. 4 is a waveform diagram showing signals which are applied to the demultiplexer.

Three demultiplex signals generated in the data driver 44 can be applied to three dumultiplex signal lines DS1~DS3. The three dumultiplex signals can be sequentially low level during one horizontal period, as shown in FIG. 4.

Actually, the first demultiplex signal of a low level can be generated in a first interval of one horizontal period, the second demultiplex signal of a low level can be generated in a second interval of one horizontal period, and the third demultiplex signal of a low level can be generated in a third interval of one horizontal period. These three low level demultiplex signals can sequentially turn on (or activate) the three transistors T1~T3.

The three transistors T1~T3 used in the present embodiment are of a PMOS type, but are not limited this. In other words, the three transistors of the present embodiment can be of a NMOS type. In this case, the three demultiplex signals each applied to the NMOS type transistors would have a high level in the three respective intervals.

In accordance therewith, the first transistor Ti is turned on (or activated) by the first demultiplex signal applied to the first dumultiplex signal line DS1, so that the red data voltage R applied to the first data signal line S1 is transferred to the first data line D1 of the liquid crystal panel 20. Therefore, the red data voltage can be applied to the red pixel region R.

The second transistor T2 is also turned on (or activated) by the second demultiplex signal applied to the second dumultiplex signal line DS2. At the same time, the green data voltage applied to the first data signal line S1 is transferred to the second data line D2 of the liquid crystal panel 20. Therefore, the green data voltage can be applied to the green pixel region G.

Similarly, the third transistor T3 is turned on (or activated) by the third demultiplex signal applied to the third dumultiplex signal line DS3. At the same time, the blue data voltage applied to the first data signal line S1 is transferred to the third data line D3 of the liquid crystal panel 20. Therefore, the blue data voltage can be applied to the blue pixel region B.

The thin film transistors included in the red, green, and blue pixel regions R, G, and B can may be turned on (or activated) by the gate signal which is enabled during one horizontal period and applied to the first gate line G1.

In this manner, when the thin film transistors on the pixel regions R, G, and B are turned on by the gate signal, which is enabled during one horizontal period, the three demultiplex signals are sequentially applied to the three demultiplex signal lines DS1~DS3 during one horizontal period. The three transistors T1~T3 included in each of the switch units 52 (including the first switch unit) are sequentially turned on (or activated) by the three demultiplex signals. Accordingly, the red, green, and blue data voltages sequentially applied to each of the data signal lines S1~S3/*m* including the first data signal line S1 can be transferred to the red, green, and blue regions R, G, and B through the data lines D1~Dm (i.e., the m/3 groups each including 3 data lines, as a first group of first to third data lines D1~D3).

To rectify this, the LCD device of the present embodiment forces each of the switch units 52 of the demultiplexer 50 to sequentially connect three data lines to one data signal line, thereby applying the red, green, and blue data voltages to the respective data lines. Accordingly, the channel number of the control portion 50 (more specifically, the data driver 44) can be decreased in one-third of the data lines of the liquid crystal panel 20. As a result, the size of the control portion 40 (i.e., the data driver 44) can be reduced.

In addition, the LCD device of the present embodiment allows the three demultiplex signal lines DS1~DS3 to connect the center portion of the data driver 44 with the center portion of the demultiplexer 50. As such, the length of the three demultiplex signal lines DS1~DS3 (i.e., the length of the transferring path of the demultiplex signals) can be minimized and the load of the signal line can be reduced. Accordingly, the deterioration of the demultiplex signals and the data voltages can be prevented.

In other words, since the three demultiplex signal lines DS1~DS3 connect the center portion of the data driver 44 with the center portion of the demultiplexer 50, the three demultiplex signals applied to the center portion of the demultiplexer 50 are transferred to the left and right ends of the demultiplexer 50. Therefore, the transferring path of the demultiplex signals can be minimized.

The gate driver 30 includes a plurality of stages (not shown). The plural stages can configure a shift register. The stages can sequentially output the clock signal generated in the control portion 40 (i.e., the clock signal generator 46) in one horizontal period unit.

Figure 5:
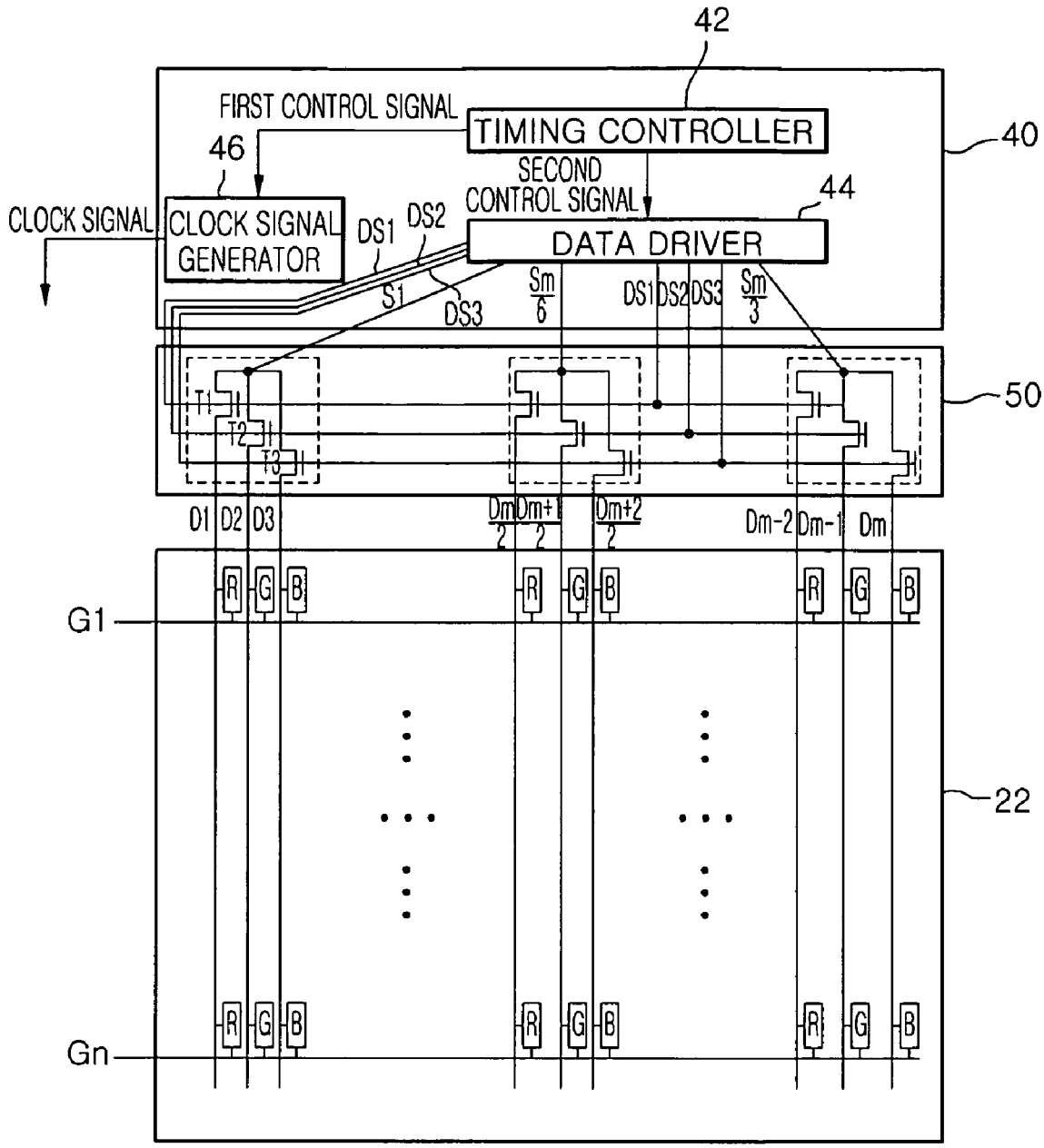
FIG. 5 is a circuitry diagram showing an LCD device according to a second embodiment of the present disclosure.

FIG. 5 is a circuitry diagram showing an LCD device according to a second embodiment of the present disclosure. An LCD device of the second embodiment includes the same components as that of the above first embodiment. Only that which differs from the LCD device of the first embodiment will be described. In particular, the LCD device of the second embodiment forces demultiplex signal lines DS1~DS3 to be connected between a center portion of the data driver 44 and a center portion of the dumultiplexer 50 as well as between an end portion of one side of the data driver 44 and an end portion of one side of the demultiplexer 50.

As such, three demultiplex signals are simultaneously applied from the center portion of the data driver 44 to the center portion of the demultiplexer 50 as well as from the end portion of one side of the data driver 44 to the end portion of one side of the demultiplexer 50. The three demultiplex signals applied to the end and center portions of the demultiplexer 50 then propagate toward the adjacent portions. Accordingly, the three dumultiplex signals can be transferred to each of the switch units of the demultiplexer 50 without deterioration.

Alternatively, the three demultiplex signal lines DS1~DS3 can be connected between an end portion of one side of the data driver 44 and an end portion of one side of the demultiplexer 50 as well as between an end portion of the other side of the data driver 44 and an end portion of the other side of the demultiplexer 50.

As described above, the LCD device of the present embodiment forces each of the switch units of the demultiplexer to sequentially connect three data lines to one data signal line, thereby applying the red, green, and blue data voltages to the respective data lines. Accordingly, the channel number of the control portion (more specifically, the data driver) can be decreased to one-third of the data lines of the liquid crystal panel 20. As a result, the size of the control portion (i.e., the data driver) can be reduced.

Also, the LCD device of the present embodiment allows the three demultiplex signal lines to connect the center portion of the data driver with the center portion of the demultiplexer. Accordingly, the length of the signal paths reaching to the data lines, which are connected to the demultiplexer, can be minimized and the load of the signal lines can be reduced. As a result, the deterioration of the data voltages can be prevented.

Although the present disclosure has been limitedly explained regarding only the embodiments described above, it should be understood by the ordinary skilled person in the art that the present disclosure is not limited to these embodiments, but rather that various changes or modifications thereof are possible without departing from the spirit of the present disclosure. Accordingly, the scope of the present disclosure shall be determined only by the appended claims and their equivalents.

What is claimed is:

1. A liquid crystal display device comprising:

a liquid crystal panel defined into a display area, on which a plurality of gate lines and a plurality of data lines are arranged, and a non-display area;

a control portion configured to include a data driver;

a plurality of first and second signal lines connected to an output stage of the control portion; and a demultiplexer configured to connect k data lines of the data lines with one line of the first signal lines and to sequentially apply the data voltages, wherein the data driver of the control portion generates data voltages and control signals for controlling the demultiplexer, wherein the first signal lines supply the data voltages, and the second signal lines supply the control signals, wherein the first and second signal lines are connected to the data driver, and wherein the second signal lines are disposed between the center portion of the data driver and the center portion of the demultiplexer and "k" is an integer of at least 3.

2. The liquid crystal display device claimed as claim 1, wherein the second signal lines are further disposed between an end portion of one side of the data driver and an end portion of one side of the demultiplexer.

3. The liquid crystal display device claimed as claim 2, wherein the second signal lines are further disposed between an end portion of the other side of the data driver and an end portion of the other side of the demultiplexer.

4. The liquid crystal display device claimed as claim 1 further comprises a gate driver embedded in the liquid crystal panel for driving the gate lines.

5. The liquid crystal display device claimed as claim 4, wherein the control portion includes:

a clock signal generator configured to generate a clock signal for driving the gate driver; and a timing controller configured to generate first and second control signals for controlling the clock signal generator and the data driver.

6. The liquid crystal display device claimed as claim 1, wherein the control signals applied to the second signal lines are generated within one horizontal period.

7. The liquid crystal display device claimed as claim 1, wherein the control signals applied to the center portion of the demultiplexer are transferred to the left and right ends of the demultiplexer.

8. The liquid crystal display device claimed as claim 1, wherein the demultiplexer includes a plurality of switch units, and wherein the switch units each includes a plurality of transistors.

9. The liquid crystal display device claimed as claim 8, wherein the second signal lines includes:

first signal lines in the demultiplexer; and second signal lines connected to the first signal lines and the data driver.

10. The liquid crystal display device claimed as claim 9, wherein the first signal lines are connected to the plurality of transistors of the respective switch units.

* * * * *